US005186568A

United States Patent [19]

Falardeau

[11] Patent Number: 5,186,568

[45] Date of Patent: Feb. 16, 1993

[54] SCAFFOLDING DOUBLE LATCH LOCKING DEVICE

[76] Inventor: Léo Falardeau, 2650, 4th Ave., Québec, Canada G1J 5E6

[21] Appl. No.: 920,906

[22] Filed: Jul. 28, 1992

[30] Foreign Application Priority Data

May 1, 1986 [CA] Canada ..... 508072

[51] Int. Cl.[5] ..... E04G 7/00

[52] U.S. Cl. ..... 403/49; 403/246; 403/330; 182/179

[58] Field of Search ..... 403/49, 246, 330; 182/179, 178

[56] References Cited

U.S. PATENT DOCUMENTS

| | | | |
|---|---|---|---|
| 2,561,938 | 7/1951 | Meng et al. | 403/49 |
| 2,674,476 | 4/1954 | Del Grosso | 182/179 X |
| 2,836,468 | 5/1958 | Jagiel | 403/49 |

FOREIGN PATENT DOCUMENTS

| | | | |
|---|---|---|---|
| 767004 | 9/1967 | Canada | 403/49 |

*Primary Examiner*—Andrew V. Kundrat
*Attorney, Agent, or Firm*—Pierre Lespérance

[57] ABSTRACT

A double latch locking device for supporting a scaffolding in erected condition. The scaffolding comprises frames parallel to one another and supported vertically by crossrods having bored ends. The latter engage a short horizontal stem projecting from the interior plane of each frame, whereas a rigid arm projects above each of the stems parallel thereto. Two latches are pivoted independently of one another to a same pivotal axis located at the free end of the rigid arm, to move within the interior plane of the corresponding frame, and are adapted to releasably retain the stay rods to the frame in a limit locking position. The present device is characterized in that it enables the locking of a variable number of stay rods on the stem with a minimum of play; the first latch will retain for example up to three stay rods which would have been engaged on the stem, whereas the second latch will retain for example up to five stay rods. The lower end of each latch is bevelled, and the rigid arm defines a seat in register with the pivotal axis, wherein in the limit locking position, any bias sustained by the latches to overcome this limit position is being completely neutralized by at least one of the latches which bears by its bevelled end against the stem and by the second latch which abuts against the seat of the rigid arm.

7 Claims, 1 Drawing Sheet

SCAFFOLDING DOUBLE LATCH LOCKING DEVICE

FILED OF THE INVENTION

The invention relates to a locking device for dismantleable scaffolding consisting of tubular frames being vertical, parallel, spaced and superimposed.

BACKGROUND OF THE INVENTION

In Canadian patent No. 767,004 issued Sep. 12, 1967 to the present inventor, a locking device for scaffolding is described and claimed. In this patent, two stay rods 21 are held in position by their bored ends on a stem 9 projecting in the interior plane of each scaffolding frame, by a locking device having a single latch 14 pivoted at one end to the free end of an arm 11 secured to the frame above the stem 9 and extending parallel thereto. The upper end 20 of a short curved stem 18 being secured to the back of latch 14, extends through arm 11, wherein latch 14 may be lifted by pulling end 20.

Latch 14 holds in position the two stay rods 21, in its lowered limit position shown in FIG. 1, thus preventing not only release from stem 9 but also preventing wobbling following vibrations generated by a worker walking over a panel supported by this scaffolding.

One disadvantage of this device, is that the latch is not destined to hold in position a variable number of stay rods, e.g. a single one, since, then, the end bore of the stay rod could be widened with wear induced by the vibrations when the stay rod wobbles on the stem, or three stay rods, when interconnected superimposed frames are used, since then, no gap will be available for the third end of stay rod.

OBJECT OF THE INVENTION

The gist of the invention is thus to provide a locking device for scaffolding consisting of vertically interconnected, dismantleable frames, which is efficient for a wide variety of assemblies of spaced and/or superimposed frames.

SUMMARY OF THE INVENTION

The prevent invention therefore constitutes an improvement over the locking device of Canadian patent 767,004. The present locking device is destined, according to the invention, to support a dismantleable scaffolding in erected condition. The scaffolding comprises at least three vertical, parallel frames of which at least two are spaced, and at least two pairs of stay rods with bored ends interconnecting said frames when the scaffolding stands in its erected condition.

Said double-latch device is destined to support in erected condition a dismantleable scaffolding, said scaffolding comprising at least three vertical, parallel frames, of which at least two are spaced, and at least two pairs of stay rods with bored ends interconnecting said frames when the scaffolding is in its erected condition; said double-latch device comprising at least one arm and a stem secured to each of said frames, said stem being parallel to said arm and underlying same, the bore end of a stay rod being able to slide along said stem, a first rigid, elongated, cross-sectionally U-shape latch defining two spaced, parallel wings being pivoted at an intermediate point to the free end of said arm around a pivotal axis for moving in an interior plane of the corresponding frame of scaffolding from a high limit position, released from said stem against the bias of gravity and enabling the free engagement and disengagement of said bored ends of stay rods and their sliding along said stem, up to a lower limit position, wherein a lock end of said first latch is destined to lock the bored end of a stay rod which would be engaged onto said stem, and a second rigid, elongated latch mounted at one end in between said wings of the first latch and pivoted by this same end to said pivotal axis of the first latch to move along the same plane of frame between the first latch and the body of said arm from a high limit position, released from said stem against the bias of gravity and enabling the free engagement and disengagement of said bored ends of stay rods and their sliding along said stem, up to a lower limit position, where a lock end of the second latch locks the bored end of a first stay rod engaged onto said stem, the lock end of said first latch being farther from said frame than the lock end of said second latch in the lower limit positions of the two said first and second latches.

DETAILED DESCRIPTION OF THE INVENTION

Figure 1:
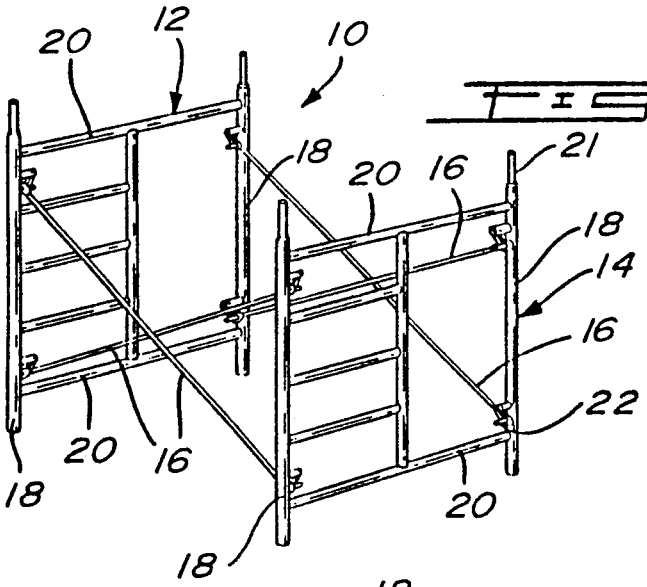
FIG. 1 is a downwardly looking perspective view of a scaffolding comprising the locking device of the invention.

Scaffolding 10 conventionally comprises, when erected, two vertical, parallel opposite frames 12, 14 being interconnected by two pairs of crossrods 16. The two stay rods of one pair are rigid and pivoted or not pivoted at their center and comprise bores at their ends. Each frame 12, 14 comprises two vertical spaced feet 18, interconnected by transverse tubes 20. The feet 18 are rigid and hollow and their upper end is provided with a pin 21 of lesser diameter to be engaged into the lower end of a foot 18 of a superimposed frame. Hence, several frames 12, 14 may thus be superimposed and held in position by additional stay rods 16. Of course, supplemental frames 12, 14 could also be added in spaced parallel positions relative to the first frames and secured thereto by additional stay rods.

Each bored end of stay rods 16 is engaged by a short stem 22 of circular cross-section, which projects from a foot 18 in the interior plane of the frame 12 or 14, and proximate a transverse tube 20. AN arm 24 of inverted U-shape in cross-section also projects rom each foot 18 and is arranged horizontally and parallel to each stem 22 immediately over the latter. The stem 22 and the arm 24 are fixedly secured to the foot 18. The arm 24 is slightly longer than the stem 22, and forms vertical, spaced wings 26, and an upper arcuate base 27 shorter than the wings 26. An elongated metallic latch 28 is pivoted at an intermediate point to a pivotal pin 30, being connected to the free end of the wings 26. One end of latch 28 is bevelled to form a terminal face 32 and an arcuate edge 34. The opposite end 36 of latch 28 projects through the cavity defined by the seat 37 at the free end offset from the base 27 of arm 24, and is of smaller thickness, to facilitate its handling.

Figure 2:
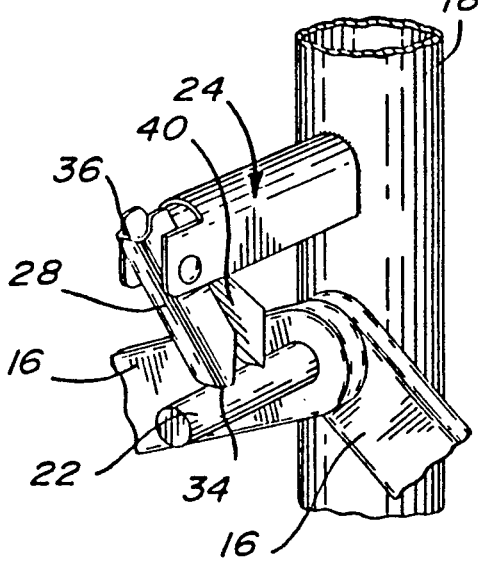
FIG. 2 is an enlarged perspective view of an embodiment of the locking device, holding in place two scaffolding stay rods.

The latch 28 has such a length, relative to the vertical distance between stem 22 of arm 24, that, when it is in standing position under the bias of gravity, as shown in FIG. 2, edge 34 may come in contact with the top of stem 22, corresponding to a lower and strained limit position of latch 28. Latch 28 is then inclined downwardly and toward foot 18, and the terminal face 32 is inclined downwardly and in a direction slightly opposite to this foot, wherein the upper terminal edge of the latch is slightly closer to this foot than edge 34. Latch 28 may be manually lifted, by pivotal motion of end 36, and be housed completely within the U-arm, 24, in its high limit position, to enable one or the other of the bored ends of the stay rods 16 to engage stem 22 or to be slidingly pulled out therefrom.

Up to this point, the hereinabove features are substantially similar to those described in Canadian patent No. 767,004.

Now, in accordance with the specific features of the present invention, latch 28 has also a cross-sectionally U-shape, so as to be able to house into its opposite wings 38 another latch 40, being elongated and rigid, full or hollow, and having dimensions similar to those of latch 28 yet at a slightly reduced scale. One end of the second latch 40 is pivoted to the pin 30, whereby the opposite end, which is also bevelled to form a terminal face 42 and a substantially acute edge 44, extends beyond the arcuate edge 34 of the first latch 28 to be nearer than the latter from foot 18.

The second latch 40 may thus freely pivot between wings 38 of the first latch 28, and the two latches 28 and 40 may pivot together between the wings 26 of arm 24 by bearing against finger 36, against the bias of gravity when it is desired to remove the stay rods 16 to dismantle scaffolding 10.

Figure 3:
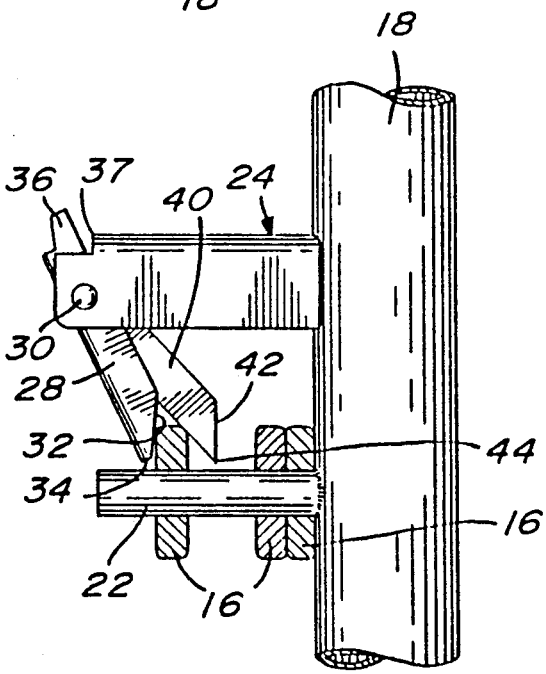
FIG. 3 is a side view of said locking device, at an enlarged scale, holding in position three scaffolding stay rods.
Figure 4:
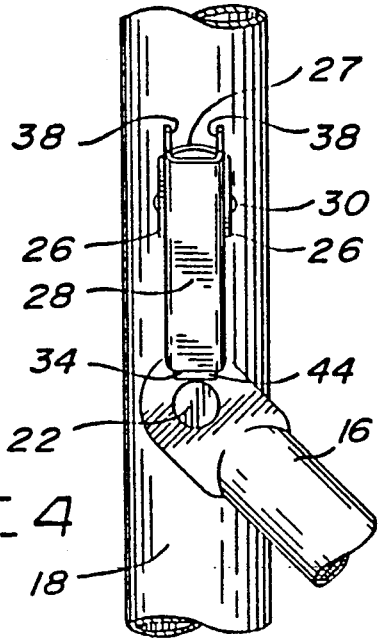
FIG. 4 is an end view of the free end of said locking device, at an enlarged scale, holding in position a single scaffolding stay rod.

The concurrent use of the two latches 28 and 40 is advantageous in that it enables an efficient locking with a minimum of play of a variable number of stay rods 16, e.g. a single one as illustrated in FIGS. 1 and 4, or two, as shown in FIG. 2 which requires three spaced parallel frames, or three stay rods, see FIG. 3 which requires at least four frames, i.e. three spaced parallel ones and a fourth superimposed one. It is understood that four or even five stay rods 16 can also be held in position by the present double-latch 28, 40, which would meet the need of most different possible assemblies of frames 12 and 14.

More particularly, when one, two or three stay rods 16 are held in place on the stem 22 of a frame 12 or 14, by the double latch 28, 40 as shown in FIGS. 1, 2 or 4, it is the terminal face 42 of the second latch 40 along which will bears against the bored end of the next stay rod 16, and its edge 44 will bear against the stem 22, whereas the end edge 34 of the first latch 28 is offset from the second latch 40 in the direction opposite foot 18, as well as relative to the stem 22 itself (see FIG. 2). Because of the bevel angle of the face 42 of the second latch 40, any bias toward double latch 28, 40 being applied by the stay rod or stay rods 16, e.g. as when a worker walks over a platform (not shown) installed onto scaffolding 10 and thus generates vibrations, will bias the latch 40 to lower still more against stem 22. Thus, the latch 40 cannot accidentally unlock, as was the case with Canadian patent 767,004, since the latches 28, 40 will automatically take a locking position under the bias of gravity, these latches can never yield, and thus, complete operational safety is achieved by the construction of the erected scaffolding. Finger 36 normally comes to bear against seat 37, which causes the locking of latch 28 in its lowered position where it is downwardly oriented substantially toward foot 18. If latch 28 comes under heavy strain, its freen end 34 will come to bear against the stem 22, and this will therefore constitute a redundant locking.

Where four or five stay rods 16 engage stem 22, the second latch 40 is lifted by the stay rods 16 and it is the first latch 28 which locks all the stay rods. FIG. 3 shows the assembly during erection of the stay rods 16 on the stem 22.

I claim:

1. A double latch device destined to support in erected condition a dismantleable scaffolding, said scaffolding comprising at least three vertical, parallel frames, of which at least two are spaced, and at least two pairs of stay rods with bored ends interconnecting said frames when the scaffolding is in its erected condition; said double-latch device comprising at least one arm and a stem secured to each of said frames, said stem being parallel to said arm and underlying same, the bore end of a stay rod being able to slide along said stem, a first rigid, elongated, cross-sectionally U-shape latch defining two spaced, parallel wings being pivoted at an intermediate point to the free end of said arm around a pivotal axis for moving in the interior plane of the corresponding frame of scaffolding from a high limit position, released from said stem against the bias of gravity and enabling the free engagement and disengagement of said bored ends of stay rods and their sliding motion along aid stem, up to a lower limit position, where a lock end of said first latch is destined to lock the bored end of a stay rod which would be engaged onto said stem, and a second rigid, elongated latch mounted at one end in between said wings of the first latch and pivoted by this same end to said pivotal axis of the first latch to move along the same plane of frame between the first latch and the body of said arm from a high limit position, released from said stem against the bias of gravity and enabling the free engagement and disengagement of said bored ends of stay rods and their sliding motion along said stem, up to a lower limit position, where a lock end of the second latch locks the bored end of a first stay rod engaged onto said stem, the lock end of said first latch being farther from said frame than the lock end of said second latch in the lower limit positions of the two said first and second latches.

2. A double latch lock device as defined in claim 1, wherein said lock end of firs latch is bevelled, to form a terminal face inclined downwardly and toward the free end of said stem in lower limit position, and an arcuate leading edge.

3. A double latch lock device as defined in claim 2, wherein said lock end of the second latch is bevelled to form a terminal face inclined downwardly and toward the free end of said stem, in the lower limit position, and an acute leading edge.

4. A double latch lock device as defined in claim 1, wherein said arm is of inverted U cross-sectional shape, defining two vertical spaced wings and an arcuate upper base, said high limit position of said latch being located in between said wings of said arm.

5. A double latch lock device as defined in claim 4, wherein said upper base of said arm is shorter than said arm wings, so that a seat offset from its free end be defined; the end opposite said lock end of said first latch bearing against said seat in said lower limit position of said first latch, so as to normally prevent any further downward pivotal motion of this latch.

6. A double latch lock device as defined in claim 1, wherein said arm is substantially longer than said stem.

7. A double latch lock device as defined in claim 3, wherein said arcuate edge of first latch is upwardly offset relative to said acute edge of second latch, the latter bearing against the stem, in said lower limit positions of the latches.

* * * * *